US005237799A

United States Patent [19]

van Boxtel

[11] Patent Number: 5,237,799

[45] Date of Patent: Aug. 24, 1993

[54] METHOD FOR MANUFACTURING CONTAINERS MADE OF FLEXIBLE MATERIAL, HAVING MULTI-LAYERS OR MULTI-SHEETS WALLS AND PRACTICALLY ASEPTIC INNER SURFACE, AS WELL AS CONTAINERS AND PACKAGES SO OBTAINED

[75] Inventor: G. J. M. van Boxtel, Tilburg, Netherlands

[73] Assignee: Crescent Holding, Netherlands

[21] Appl. No.: 797,588

[22] Filed: Nov. 25, 1991

[30] Foreign Application Priority Data

Nov. 28, 1990 [EP] European Pat. Off. ..... 90203146.7

[51] Int. Cl.[5] ..... B31B 39/00; B65B 9/08

[52] U.S. Cl. ..... 53/426; 53/455; 493/198

[58] Field of Search ..... 53/455, 459, 468, 425, 53/426; 493/97, 98, 96, 198

[56] References Cited

U.S. PATENT DOCUMENTS

| | | | |
|---|---|---|---|
| 3,194,124 | 7/1965 | Warp | 493/198 X |
| 3,552,278 | 1/1971 | Guenther | 493/198 X |
| 3,743,567 | 7/1973 | Abler | 493/198 X |
| 4,945,713 | 8/1990 | Widenbäck | 493/198 X |

FOREIGN PATENT DOCUMENTS

| | | | |
|---|---|---|---|
| 748168 | 12/1966 | Canada | 493/97 |

*Primary Examiner*—James F. Coan

*Attorney, Agent, or Firm*—Ostrolenk, Faber, Gerb & Soffen

[57] ABSTRACT

A continuous band of containers containing two rows of containers with each row joined to an opposite edge of an elongated joining strip, is produced by positioning a flattened elongated tube of plastic heat sealable material so that it is centered with respect to the longitudinal center-line of an elongated reinforcing sheet. The width of the flattened tube equals twice the height (H) of each container plus the width "d" of the joining strip. The longitudinal edge portions of the reinforcing sheet are folded inwardly over the longitudinal edges of the flattened tube to be separated by distance "d". Aligned transverse welds, each of length H, are then made to extend inwardly from opposite longitudinal edges of the flattened tube and weld two layers of the folded tube together with two layers of the reinforcing sheet. Each pair of aligned welds is spaced from the next pair of aligned welds by distance "L" equal to the container width. The transverse welds are then perforated along their longitudinal center-lines and thereafter the exposed upper layer of the flattened tube is slit longitudinally to form a strip of width "d" that is removed to provide oppositely facing openings through which the containers are filled. After the containers are filled, the filling openings are sealed, the joining strip and the tube layer secured thereto are removed, and the filled and closed containers are separated from each other by tearing along the perforations through the transverse welds.

13 Claims, 3 Drawing Sheets

METHOD FOR MANUFACTURING CONTAINERS MADE OF FLEXIBLE MATERIAL, HAVING MULTI-LAYERS OR MULTI-SHEETS WALLS AND PRACTICALLY ASEPTIC INNER SURFACE, AS WELL AS CONTAINERS AND PACKAGES SO OBTAINED

DESCRIPTION

This invention relates to a method to implement containers generally provided with multi-layers walls, already suitable to be filled in aseptic conditions.

In the field of the packaging of alimentary and dietetic products as well as liquid and powdered medical products which, due to their peculiar characteristics must be packed in containers of a certain capacity, for example in form of bags, it is essential, for sanitary reasons and preservation requirements that the internal surfaces of such containers be kept aseptic.

The procedures presently known in the art for the preparation of such containers generally involves a first step of manufacturing said containers in normal ambient conditions, followed by a sterilization step and successive steps of handling and filling of the containers in a sterilized area; the last operations needs the use of complicated plants involving high process costs.

The purpose of the present invention is to provide an economic and high productivity method apt to permit, in a normal ambient, the expeditions realization of containers already internally aseptic, and shaped so as to be easily collected for successive filling and sealing, utilizing an equipment of reduced dimensions housed within a sterilized chamber of a very limited size.

According to the invention, the proposed scope is achieved by realizing a band formed by a row of opposed pairs of containers, practically aseptic internally, interconnected by a union strip and apt to be collected either in the form of a coil or to be folded up into containment boxes; said container may be 11 opened, filled and sealed using a simple device of reduced dimensions housed in a sterilized chamber of limited volume.

The preparation of these continuous and practically aseptic containment bags is effected, in the first stage, in a normal working ambient to form a semi-finished band shaped as a tubular element of plastic material, this tubular element being practically internally aseptic due to the extruding temperature and being collectable even in considerable length, in flattened coil form.

In the second step of production, which may likewise be carried out in a normal ambient, the flattened tubular band, having a transversal width equal to twice the height of the container, increased by the width of a central union strip, also double walled, is caused to advance on a heat sealing device, on which said tubular element is partly lined, generally, with a further sheet of different material for example, aluminum foil acting as external reinforcement and barrier against atmospheric agents for the bag, to form, in any case a surface on which markings and/or instructions to users may be printed and, moreover, to act as a support to maintain each single bag in standing position. This second step which may also be performed on line or in series with the first phase does away with the need for intermediate winding of the semi-finished flattened tube, includes performing of transversal heat seals made at longitudinal pre-established intervals equal to the width of the containers themselves to be realized, said transversal seals being apt to form the lateral closing ribs for the single containers. The length of the transversal seals reaches toward the longitudinal center line of the band for a tract equal to the height of the containers to be realized.

In this manner, also the lining sheet is caused to adhere to the flattened tube and, as a final operation of the preparatory phase, cuts are performed, preferably in perforated dotted form on the center line of the transversal seals, without affecting the middle union strip, in order to permit the detachment of the pairs of lateral opposite bags and maintaining its practically aseptic internal condition, said bags remaining joined as a band thanks to the central union strip.

The containers thus prepared are collected in the form of coils or introduced, folded concertina wise, in boxes to be fed to a filling facility of reduced dimensions which may not necessarily be a part of this production process and which may be located also by others, user factories which may provide to fill and seal the containers.

By way of example, an equipment of this type is equipped with a support guide which progressively narrows down in order to assume, at the point adjacent to the filling station, a width corresponding to that of the union strip of the opposite pairs of containers which set themselves vertically hang astride the the support itself. The band of containers, caused to advance by a pinion gear engaging with said union strip, passes under a longitudinal cutting assembly, which incises, into a sterilized ambient, one of the layers of the union strip which is collected and removed for recycling, thus opening two opposite apertures in the containers, practically aseptic internally and which may be filled and immediately closed by longitudinal heat sealing weld to preserve the internal sterility of the container. After this the second recyclable layer of the union strip is also cut and removed for collection, on the opposite sides of the equipment, where the filled and closed containers are picked.

The invention will now be described in conjunction with the drawings which illustrate a preferred form of embodiment of the band of practically aseptic containers to be proceed on a filling apparatus.

Figure 1:
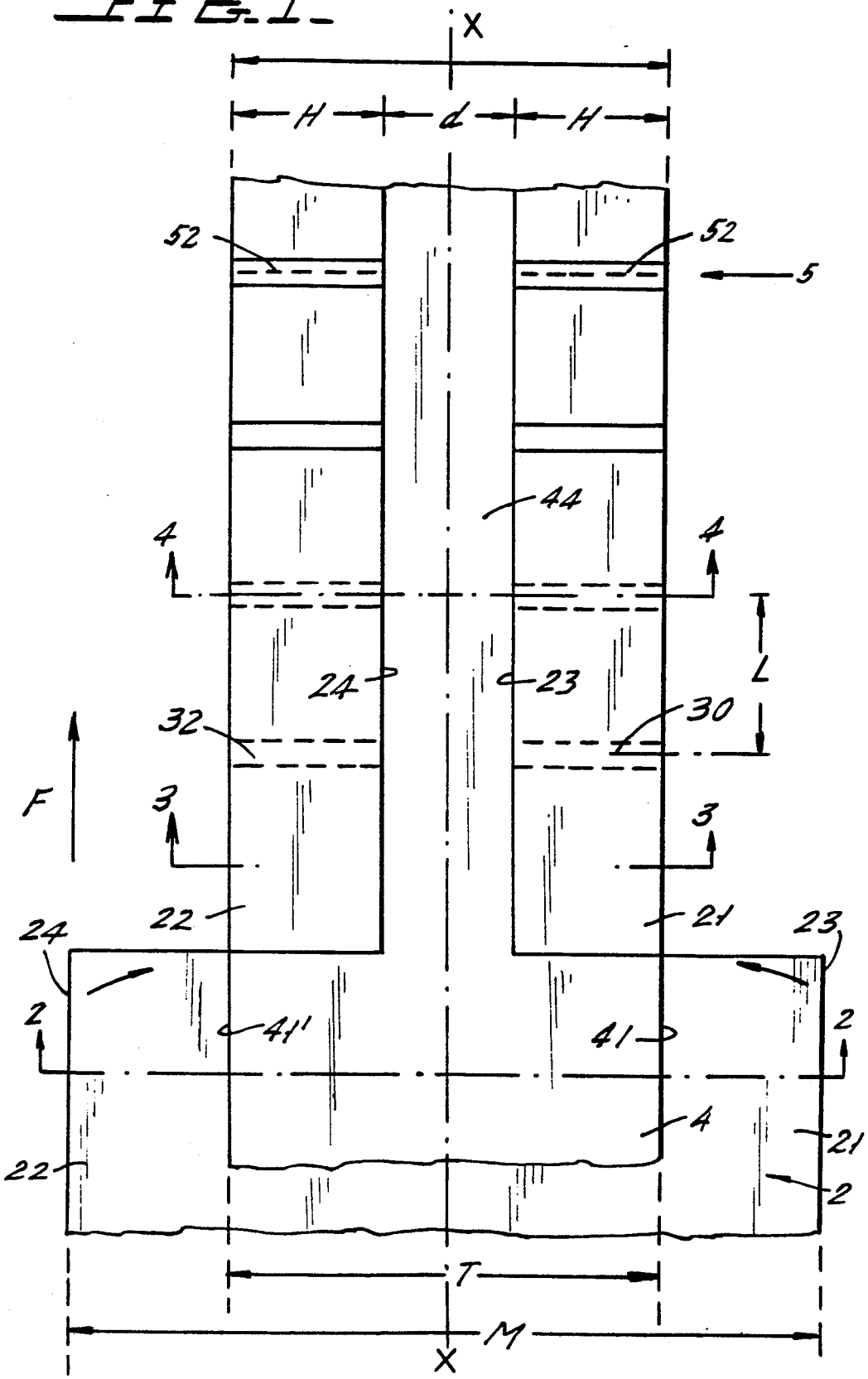
FIG. 1 shows in plant view from the above and in sequence relationship the production of a plurality of pair of opposite containers which are practically aseptic making part of a continuous band, derived from a drawn tube of a thermosealable flexible material and covered by a support or back sheet, in accordance with the invention.

FIG. 1 is a plan view showing sequentially, from bottom to top the advancement, according to production direction "F", of a sheet 2 made of flexible material, for example a thin aluminum sheet coupled to a suitable thermo-sealable support, on which is overlapped and centered, on mid line X—X, a flattened thin tube 4 made of plastic heat sealable material, wound beforehand in the form of a coil or coming directly from the extruding facility and in any case practically internally aseptic. The width T of flattened tube 4 will be equal to twice the designated height H of the containers increased by width "d" of a union strip for the pairs of containers and which is commensurate to the width of the support guide of the final container's filling equipment. The transversal width "M" of reinforcing sheet 2 is substantially equal to 2T-d.

Figure 2:
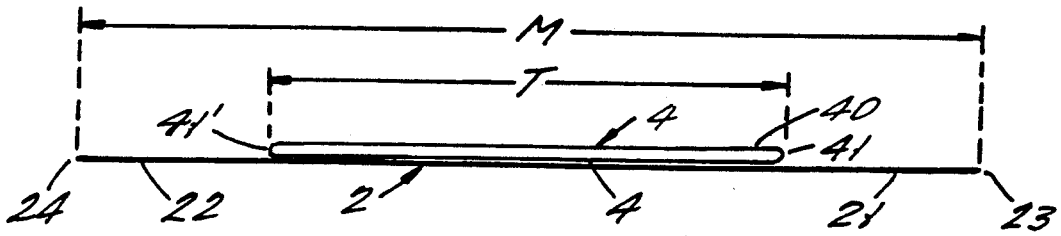
FIG. 2 is a cross sectional view taken along lines II—II of FIG. 1.
Figure 3:
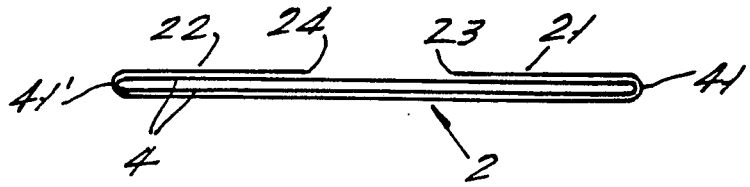
FIG. 3 is a cross sectional view along lines III—III of FIG. 1.

FIG. 2 shows section II—II in this first processing step. In the second step, (see FIG. 3) the side edges 21 and 22 of sheet 2 are bent over around edges 41, 41' of flattened tube 4, to overlap laterally on the latter and leave free only a triple wall center strip 44 forming the union strip of the pairs of containers.

Figure 4:
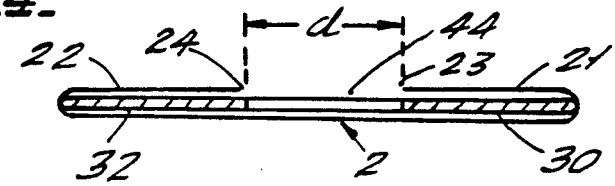
FIG. 4 is a cross sectional view taken along lines IV—IV of FIG. 1.

After folding over of side edges 21 and 22 of the supplementary sheet 2, forming the outer envelope of the containers, a third production step takes place, in which opposite heat seals or thermo-seals 30 and 32 are performed, longitudinally spaced with respect to each other at a distance L corresponding to the width fixed in advance for the containers, said transversal seals extending toward the center line X—X, its ends being substantially aligned with the borders 23, 24 of the folded over edges 21 and 22 over a distance H corresponding to the desired height of the containers so as to leave free the aforementioned union strip 44, having a width equal to "d". This processing step, shown in FIG. 4 corresponds to section IV—IV of FIG. 1. On this figure it can be seen that heat seals 30 and 32 connect to each other only the opposite walls of tube 4. Simultaneously or in a successive fabrication step securing of the heat sealable material of internal tube 4 to the supplementary layer 2 is performed, at the position coinciding with transversal seals 30-32.

In a further production step corresponding with pos.V of FIG. 1, still in their internally closed condition are almost totally separated from each other by cuts 52, preferably dotted perforations, on the centerline of seals 30 and 32, the length of said in incisions being slightly less than "H" in order to not affect lateral edges 41,41' of flattened tube 4.

The bag type containers may be fitted, if necessary, with a bellows bottom suitable to obtain packages apt to be self supporting in upright position to improve display. Said configuration can be obtained by sealing the walls of the flattened tube 4 substantially in the form of the arc of a circle with concave part facing axis x' x of the band.

At the end of the operations above described, a band of container pairs is obtained which can either be wound up on spools or folded concertinawise in suitable boxes to be supplied to the packaging companies for filling in a sterilized chamber, the containers by means of suitable apparatuses. Naturally, this operation can also be performed by the producer of the containers with a complete facility for fabrication and filling of the containers themselves.

In view of what above stated, it is evident the usefulness of the method described, according to which it is possible to obtain, in a normal non-aseptic environment (ambient), hence much easily, a plurality of practically aseptic containers apt to be utilized either directly or to be supplied to packaging companies for feeding into filling machines of simple structure and limited dimensions.

Figure 5:
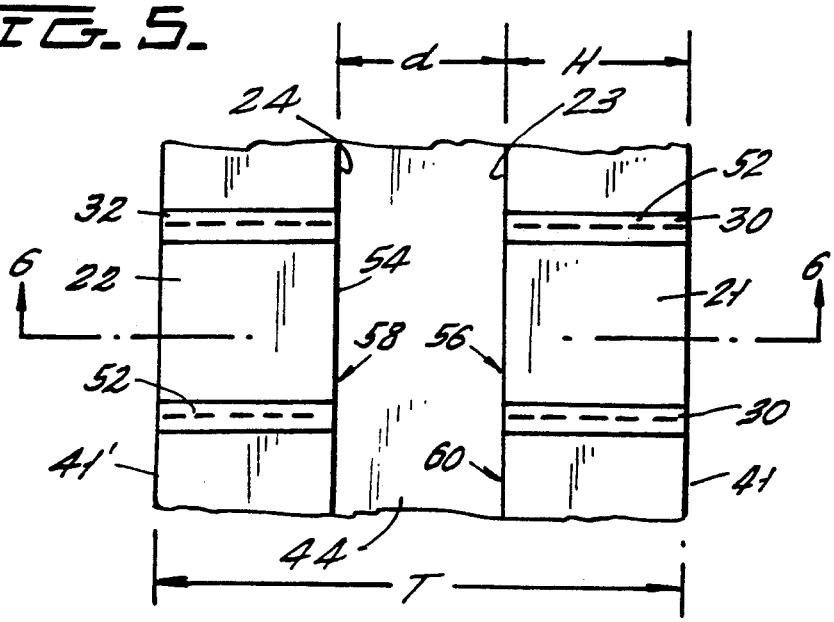
FIG. 5 shows a part of band of containers in the first production step on the filling facility, from above.
Figure 6:
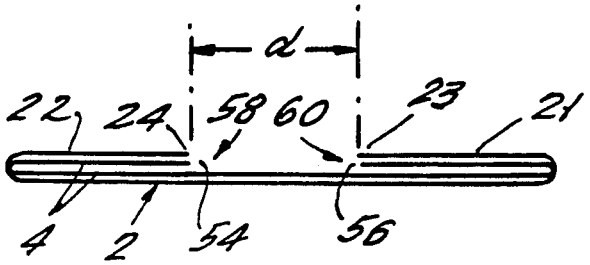
FIG. 6 shows section VI—VI of FIG. 5
Figure 7:
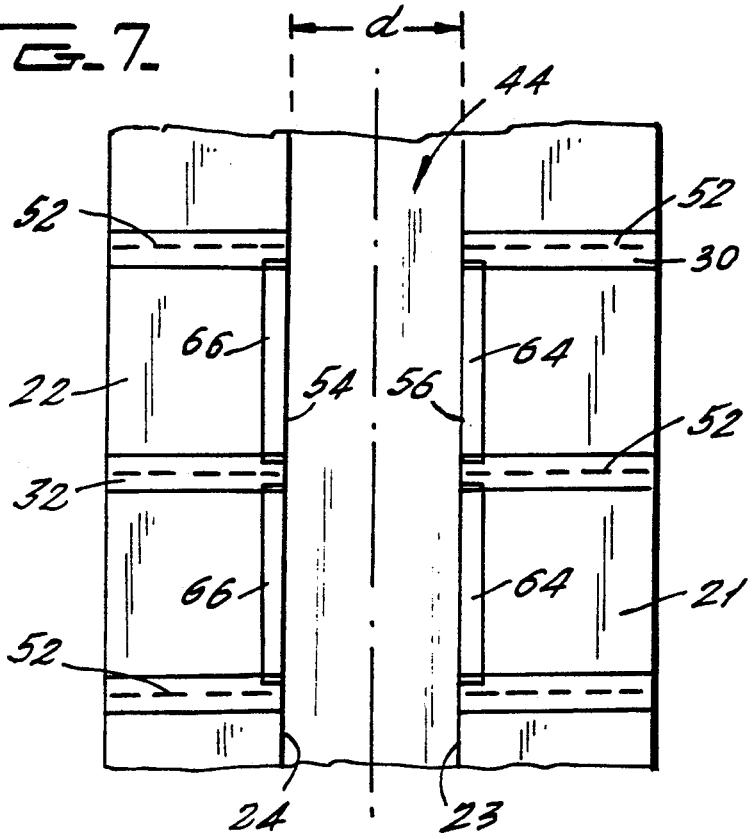
FIG. 7 illustrates the closing phase of the containers, also plan view.

FIGS. 5, 6 and 7 show the production phases on the filling facility. For the sake of clarity, it is assumed that the containers are arranged on a horizontal plane rather than being appended vertically to the sides of the central support of the filling facility itself.

Figure 8:
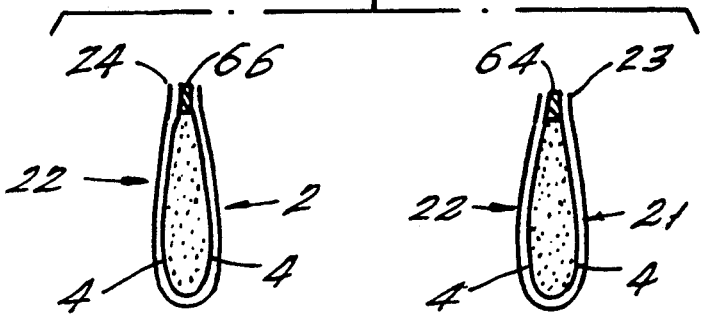
FIG. 8 is a view, in cross section, of a pair of opposite containers filled, sealed and detached from each other in their real vertical position at the terminal of the filling and sealing facility.

According to FIG. 5, as a first step, two longitudinal cuts 54 and 56, at a distance H respectively from lateral edges 41 and 41' of flattened tube 4 are provided, said cuts being limited to the top layer of union strip 44. The upper layer may be taken up and wound on a small spool as material to be recovered and recycled, thus providing (see FIG. 6) two openings 58 and 60 on the opposite container. After filling the containers, the devices on the facility provide immediate sealing (see FIG. 7) of said openings by longitudinal welds 64 and 66 which overlap in seal tight relation at their ends, on seals 30 and 31. Lastly the process continues by cutting the remaining lower union strip 44 formed by the residual wall of tube 4 and the underlying supplementary strip 2, which are also wound on another small spool as material to be recycled, thereby freeing the filled containers as shown in cross section in FIG. 8.

Preferably, the containers are filled by utilizing machinery that is disposed within a small sterilized chamber to preserve the relatively aseptic conditions within the folded tube from which the containers are provided.

Although the present invention has been described in relation to particular embodiments thereof, may other variations and modifications and other uses will become apparent to those skilled in the art. It is preferred, therefore, that the present invention be limited not by the specific disclosure herein, but only by the appended claims.

I claim:

1. Method for the fabrication of containers in flexible material with multiple layer walls and with relatively aseptic internal surfaces, characterized by the following steps:

a) production of a band in the form of a flattened tube made of plastic heat sealable material which includes a relatively aseptic inside surface, the flattened tube having a width (T) equal to twice the height (H) foreseen for the containers being fabricated, increased by the width "d" of a central joining strip;

b) positioning of the flattened tube centered on the longitudinal mid-line of an outer reinforcing sheet formed as a band made of a different material than that of such flattened tube, and having a width (M) equal to (2T−d);

c) inwardly bending of the edges of the outer reinforcing sheet over the lateral edges of the flattened tube while leaving a longitudinally extending portion of its upper surface uncovered over a width d;

d) perform, in sequence, transversal opposite welds evenly spaced from the each other at a distance (L) equal to the width foreseen for the containers being fabricated, each weld extending from said lateral edges toward the mid-line of the bands for a distance (H) equal to the height foreseen for the containers, to internally join the walls of the flattened tube and the outer reinforcing sheet to form the sides of the containers themselves which containers are arranged in pairs having openings that face one another with said pairs being joined together as a continuous band of containers;

e) perform transversal cuts on the center line of said transversal opposite welds, said cuts being configured and operatively constructed to allow the containers to be separated laterally from each other, said containers remaining joined to each other centrally, end to end;

f) cut the top surface of the flattened tube along two parallel longitudinal lines spaced by distance "d" and positioned along opposite sides of said longitudinally extending portion, to form a removable strip of plastic heat sealable material and form a number of pairs of oppositely facing container openings, and remove the strip;

g) fill the containers and seal them immediately afterward by heat sealing, then cut completely the remaining part of the joining strip consisting, respectively, of a layer of plastic heat sealable material and a layer of said different material, in order to separate the filled and closed containers from each other.

2. Method according to claim 1, characterized in that the transversal cut on the center line of the transversal welds is effected, starting from a point slightly inboard with respect to the side edges of the band, on both sides of same, so as to leave each of the pairs of containers joined to the immediately preceding and immediately succeeding pairs of containers by means of at least one connection point obtained by interrupting the transversal cut near the bottom of the container, that is near the lateral edges of the band of containers.

3. Continuous band of containers obtained in accordance with the method of claim 1, characterized in that the containers have an internal closed and relatively aseptic space, comprised between the double wall of a flattened tube (4) and are arrange combwise in two parallel rows on the sides of a double center joining strip (44), said containers being delimited from each other transversely by heat seals (30, 32) that constitute said welds and forming a single chamber intercommunicating with a central tubular space, which is also closed and relatively aseptic, and which corresponds to said double center joining strip having a width (d).

4. Continuous band of containers according to claim 3, characterized in that the transversal heat seals (30, 32) are performed at regular intervals (L), equal to the width of the containers themselves, said transversal heat seals extending toward the mid line (X—X) of the band, starting from its lateral edges for a length "H" substantially equal to the final height of the containers.

5. Continuous band of containers according to claim 3 characterized in that the containers are lined with a layer (2) of reinforcing material folded over the side edges (41, 41') of the flattened tube (4), the folded edges (21 and 22) of which extend toward the mid line X—X of the band over a width substantially equal to length "H" of heat seals (30–32).

6. Continuous band of containers according to claim 5, characterized in that the folded edges (21–22) of the layer (2) of reinforcing material are secured on the transversal heat seals (30–32).

7. Continuous band of containers according to claim 3, characterized in that the containers are separable from each other laterally by means of transversal cuts (52). performed on the mid line of the single transversal heat seals (30–32), said transversal cuts extending toward the edges of the band over a length substantially equal to that of said transversal heat seals (30–32) so as to maintain the band of containers constantly joined by means of the central joining strip (44).

8. Continuous band of containers according to claim 3, characterized in that the paired containers are joined to the immediately preceding and immediately succeeding pairs of containers by at least one connecting point provided by interrupting the transversal cuts (52) at a point coinciding with the bottoms of the containers, said bottoms being disposed adjacent to the lateral edges of said band of containers.

9. Method according to claim 1, characterized in that between method steps e) and f) the continuous band of containers is wound on a spool.

10. Method according to claim 1, characterized in that the outer reinforcing sheet is a coupled aluminum foil.

11. Method according to claim 10, characterized in that the plastic heat sealable material is recyclable.

12. Method according to claim 1, characterized in that between method steps e) and f) the continuous band of containers is folded concertina-wise.

13. A continuous band of containers according to claim 5 in which the reinforcing material is comprised of a thin reinforcing sheet of coupled thermoweldable aluminum foil.

* * * * *